US005850663A

United States Patent [19]

Hardy et al.

[11] Patent Number: 5,850,663

[45] Date of Patent: Dec. 22, 1998

[54] ERGONOMIC TOOL HANDLE

[75] Inventors: Thomas B. Hardy; Mark S. Corriveau, both of Sturbridge, Mass.

[73] Assignee: Hyde Manufacturing Co., Southbridge, Mass.

[21] Appl. No.: 597,846

[22] Filed: Feb. 7, 1996

[51] Int. Cl.[6] ..... A47L 13/022; B05C 17/10; E04F 21/06

[52] U.S. Cl. ..... 15/236.01; 15/143.1; 15/245.1; 30/169; D8/45; D32/49

[58] Field of Search ..... 15/235.4, 143.1, 15/236.01, 245.1; 16/110 R; 30/169, 340; 81/177.1, 489; D8/45; D32/40, 46–49

[56] References Cited

U.S. PATENT DOCUMENTS

| | | | |
|---|---|---|---|
| 673,506 | 5/1901 | Pitts | 15/143.1 X |
| 936,695 | 10/1909 | Barth | 15/236.01 |
| 1,432,798 | 10/1922 | Spence, Jr. | 15/236.01 |
| 1,704,376 | 3/1929 | Teasdale | 15/236.01 X |
| 2,162,117 | 6/1939 | Perry | 81/489 |
| 2,421,339 | 5/1947 | Leger | 30/340 X |
| 2,487,291 | 11/1949 | Abruzzese | 30/169 X |
| 4,248,660 | 2/1981 | Johnson | 15/236.01 X |
| 4,536,910 | 8/1985 | Clark | 15/236.01 X |
| 4,962,561 | 10/1990 | Hamilton | 15/143.1 X |
| 5,465,449 | 11/1995 | Lewkowicz | 15/143.1 X |

FOREIGN PATENT DOCUMENTS

| | | | |
|---|---|---|---|
| 42971 | 1/1982 | European Pat. Off. | 15/235.4 |
| 7800707 | 7/1979 | Netherlands | 15/236.01 |
| 2207379 | 2/1989 | United Kingdom | 15/236.01 |

*Primary Examiner*—Mark Spisich
*Attorney, Agent, or Firm*—Louis J. Franco

[57] ABSTRACT

An ergonomic handle for a spreading tool designed to permit and encourage the user to grasp the handle with his/her fore and middle fingers extended onto the blade. The extended fingers are fully supported by an arch in the head of the handle, which combined with its comfortable gripping portion for the palm, thumb, ring and little fingers, allows proper alignment of the wrist and increased leverage on the blade while working the tool, yet minimizes fatigue, pain and the potential for injury.

19 Claims, 12 Drawing Sheets

ERGONOMIC TOOL HANDLE

FIELD OF THE INVENTION

The present invention relates generally to spreading tools with gripping handles. Specifically, the invention relates to broad knives and putty knives for applying joint-compound and tape, plaster, and putty.

BACKGROUND OF THE INVENTION

During construction, home fix-up, craft-making, and various other tasks, flat-bladed tools are employed to apply materials such as putty, plaster and joint compound, and to spread and smooth joint tape. These tools are known generally as broad knives, joint knives and putty knives. Such knives are identified by a thin-walled flat blade, often flexible, which extends from a co-planar gripping handle. The blade has a working edge substantially perpendicular to, and co-planar with, the handle axis. When held against a work surface for use in a typical fashion, the handle axis is disposed at an acute angle to the plane of the work surface, while the working edge lies on the plane of, and in contact with, the work surface. Substantial force is applied at the handle, through the blade, and to the work surface in most applications. This provides for a more even and less wasteful spreading during compound application. A typical broad knife of the prior art is depicted in FIGS. 1A through 1E.

Handles of such prior art tools were generally flat and co-planar with the tool blade. Such handles are designed primarily for gripping; by wrapping the thumb, palm and all four fingers around the handle as depicted in FIG. 1C. This traditional wrap-around gripping has been found to cause discomfort and fatigue to the hand and wrist. The hand is forced to turn sharply outwardly at the wrist in an un-natural position so that the four fingers may engage one side of the handle while the thumb engages the other. The application of adequate pressure on the blade by applying force to the extended handle, at the opposite end of the tool from the working edge, is quite burdensome and uncomfortable. Consequently, many users, in an attempt to alleviate these problems, extend their fore and middle fingers over the head of the handle as shown in FIGS. 1D and 1E, pressing down directly on the blade with the tips of their fingers. This results in improved leverage and more natural wrist alignment, but prior art handles do not provide adequate support for the naturally arched posture of the extended fingers, leading to pain and fatigue during prolonged employment of this type of grip. Many long-term users, such as professional plasterers and drywall installers, have developed cumulative trauma disorders such as "carpal-tunnel syndrome" from such misuse of the hand and wrist.

Further drawbacks in the design of such prior art handles are manifested by the inferior quality of the work done therewith. For instance, in order that a smooth, flat, and efficient layer of plaster result when plastering, which requires pulling the tool toward the user, the blade edge must not only be forced against the work surface, but must be kept level. The pressure applied must be evenly maintained. Such requirements are difficult to fill with such an awkward and unnatural gripping position, especially as fatigue and cramping set in, resulting in a bumpy or uneven layer of plaster in many cases.

Consequently, the construction, home repair and craft industries have long felt the need for a spreading tool having a handle designed to provide a more functional, efficient and comfortable grip.

SUMMARY AND OBJECTS OF THE INVENTION

The present invention is a spreading tool having a handle that is shaped to better accommodate and support the hand and fingers, permitting a more functional and comfortable gripping position, with the wrist and hand in natural alignment, and the extended fore and middle fingers fully supported by the head of the handle as they press against the blade. Further, the arched finger support greatly improves the grip while pulling or drawing the tool along the work surface, as required for spreading putty, plaster, drywall compound or tape. Higher leverage is attained allowing greater force on the blade. Also, this gripping posture augments better control of the tool, improving the user's "feel" and yielding higher quality work.

The handle is comprised of gripping and finger support portions; the latter being adjacent to the tool blade and disposed between the blade and gripping portion. The gripping portion of the handle is shaped and oriented so that the thumb, palm, ring and little fingers wrap comfortably therearound, augmented by an appropriate recess on the underside of the handle, allowing the hand and wrist natural posture and alignment while the fore and middle fingers are directed towards the blade. The finger support portion is arched to match the natural contour of the undersides of the fore and middle fingers providing positive engagement therewith as the tool is drawn over the work surface.

It is the object of the present invention to reduce fatigue and physical damage to the hand, fingers and wrist, and to accommodate gripping by a properly positioned hand.

It is a further object to provide a handle which is shaped to suggest such a proper gripping position, to aid those without experience in the use of such tools by leading them to grip the tool in the proper position.

It is a further object to provide such a tool which is shaped for use by either right-handed or left-handed users.

It is a further object to provide such a handle which may be inexpensively produced by such means as injection molding or die casting.

It is a further object to provide such a handle with various portions having selected surface qualities, such as texture and softness, to further improve comfort and gripability, as well as aid in suggesting proper gripping position.

Further objects and advantages of the present invention will be best appreciated and more fully understood in reference to the herein described preferred embodiment and the appended drawings, of which the following is a brief description.

DESCRIPTION OF THE PREFERRED EMBODIMENT OF THE INVENTION

Figure 1A:
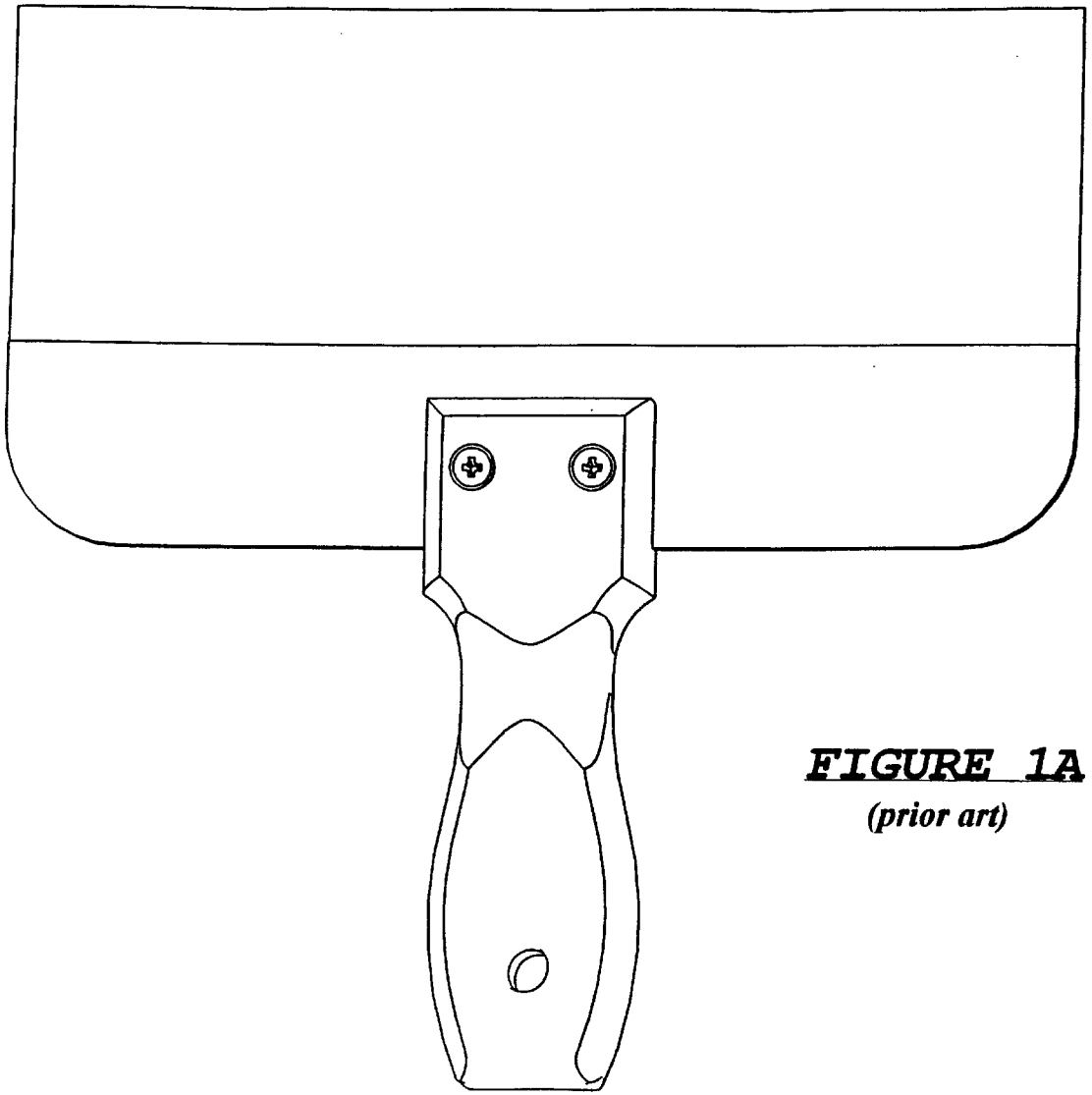
FIGURE 1A (prior art)
FIG. 1A is a top view of a broad knife in accordance with the prior art.
Figure 1B:
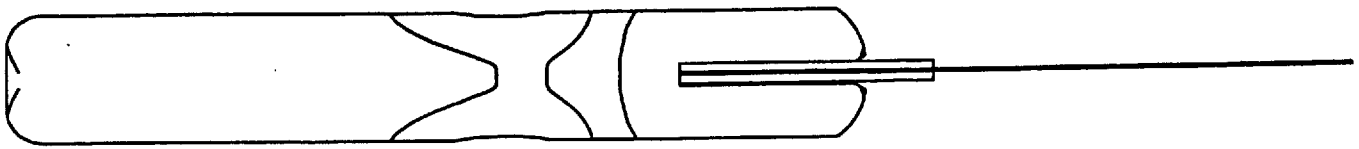
FIGURE 1B (prior art)
FIG. 1B is a side view of the prior-art broad knife of FIG. 1A.
Figure 1C:
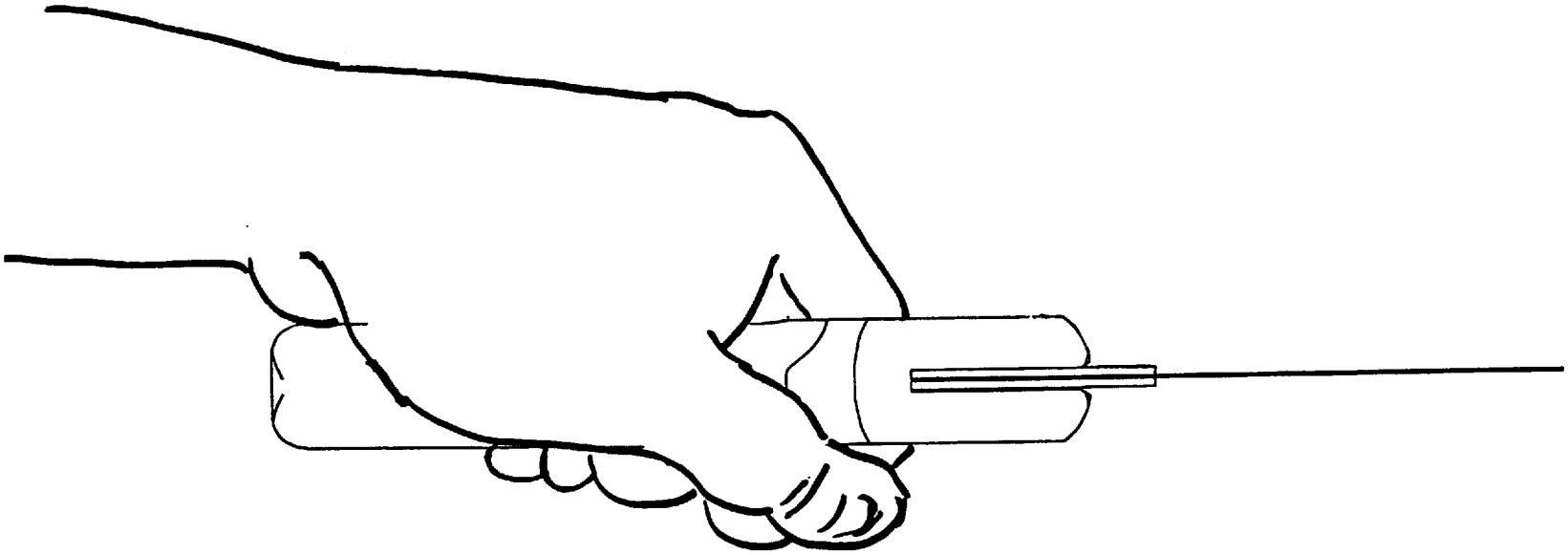
FIGURE 1C (prior art)
FIG. 1C is a side view of the prior art broad knife of FIG. 1A being held in the traditional position by a left hand.
Figure 1D:
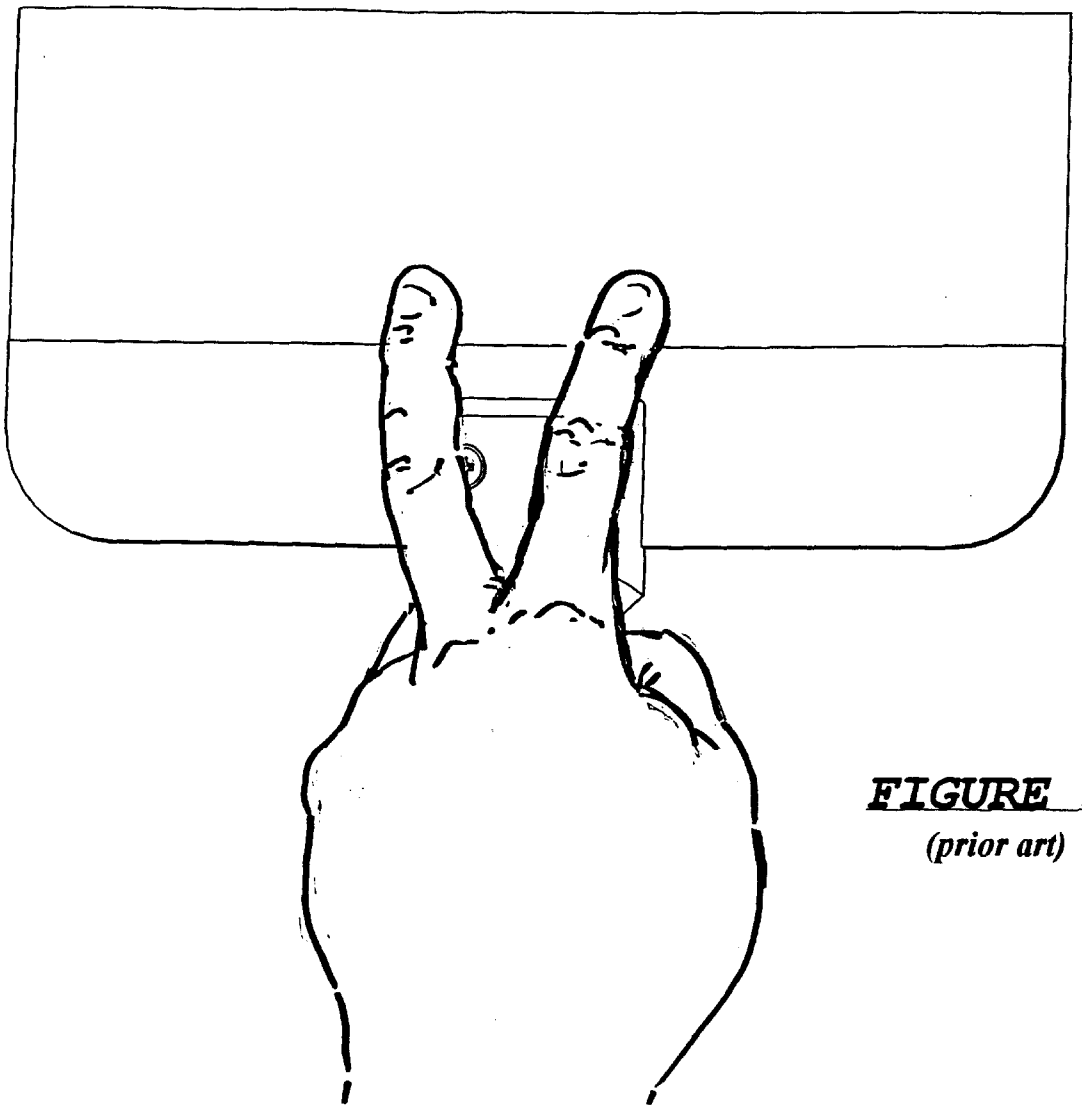
FIGURE 1D (prior art)
FIG. 1D is a top view of the prior art broad knife of FIG. 1A being held with fore and middle fingers extended over the head of the handle and pressing on the blade.
Figure 1E:
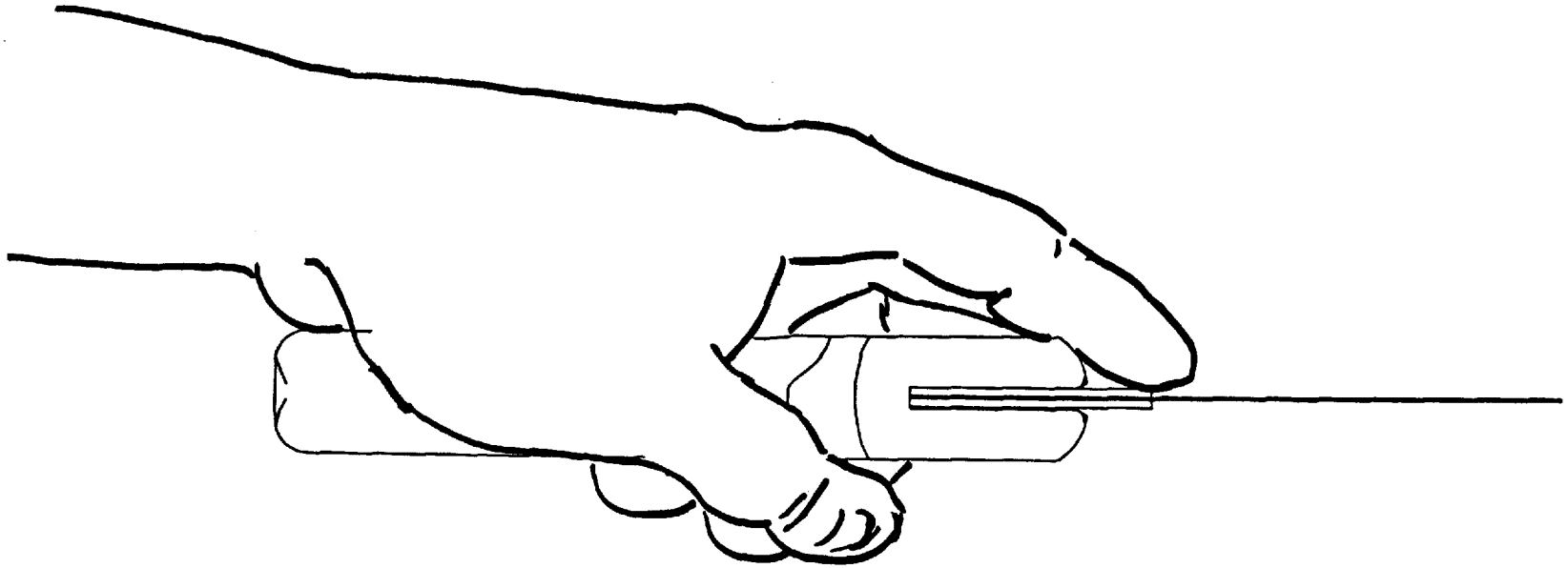
FIGURE 1E (prior art)
FIG. 1E is a side view of the prior art broad knife of FIG. 1A being held with fore and middle fingers extended over the head of the handle and pressing on the blade.

Reference is now made to the preferred embodiment of the invention which is depicted in FIGS. 2A through 2G. The preferred embodiment is a broad knife 200 having a flat steel blade 201 and a molded plastic elongated handle 202. The handle 202 is rigidly affixed to the blade 201 by two rivets 203. Alternatively, the handle 202 and blade 201 could be affixed by screws, clips, or by insert-molding of the handle 202 onto the blade 201, or by any of a number of other means, including press fit or friction retention.

The blade 201 comprises a rectangular sheet steel panel 204 lying in a blade plane BP and having a straight working edge 205 adapted for contacting a work surface and a rear blade edge 206 opposite working edge 205. The sheet steel is relatively flexible. A reinforcing backing 207 encases the rear blade edge 206. The reinforcing backing 207 is attached to the blade 201 by welding, riveting or swaging and serves to stiffen the blade 201 transversely while allowing longitudinal flexibility. Two holes 210 through the blade 201 and reinforcing backing 207 accept the rivets 203 for attachment of the handle 202.

The handle 202 comprises a front end 214, a rear end 215, a top surface 216 and a bottom surface 217. The top surface 216 includes surfaces 216*a*, 236, and 237 which surfaces are further described and explained below. The handle 202 further includes a gripping portion 220 adjacent the rear end 215, the gripping portion 220 having upper surface 216*a* and a lower surface 217*a*, and an arched finger support portion 230 adjacent the front end 214 of the handle 202 and preferably integrally molded with the gripping portion 220 to form a singular rigid component. The handle 202, as previously stated, is preferably affixed to the blade 201 by rivets 203 which extend through holes 213 in the finger support portion 230 of the handle 202 and through holes 210 in the blade 201, resulting in a unitary tool 200. The blade 201 is affixed to the handle 202 that the blade plane BP passes between the top and bottom surface 216 and 217 of the handle 202 and the gripping portion 220 extends generally rearward of the rear blade edge 206.

Figure 2A:
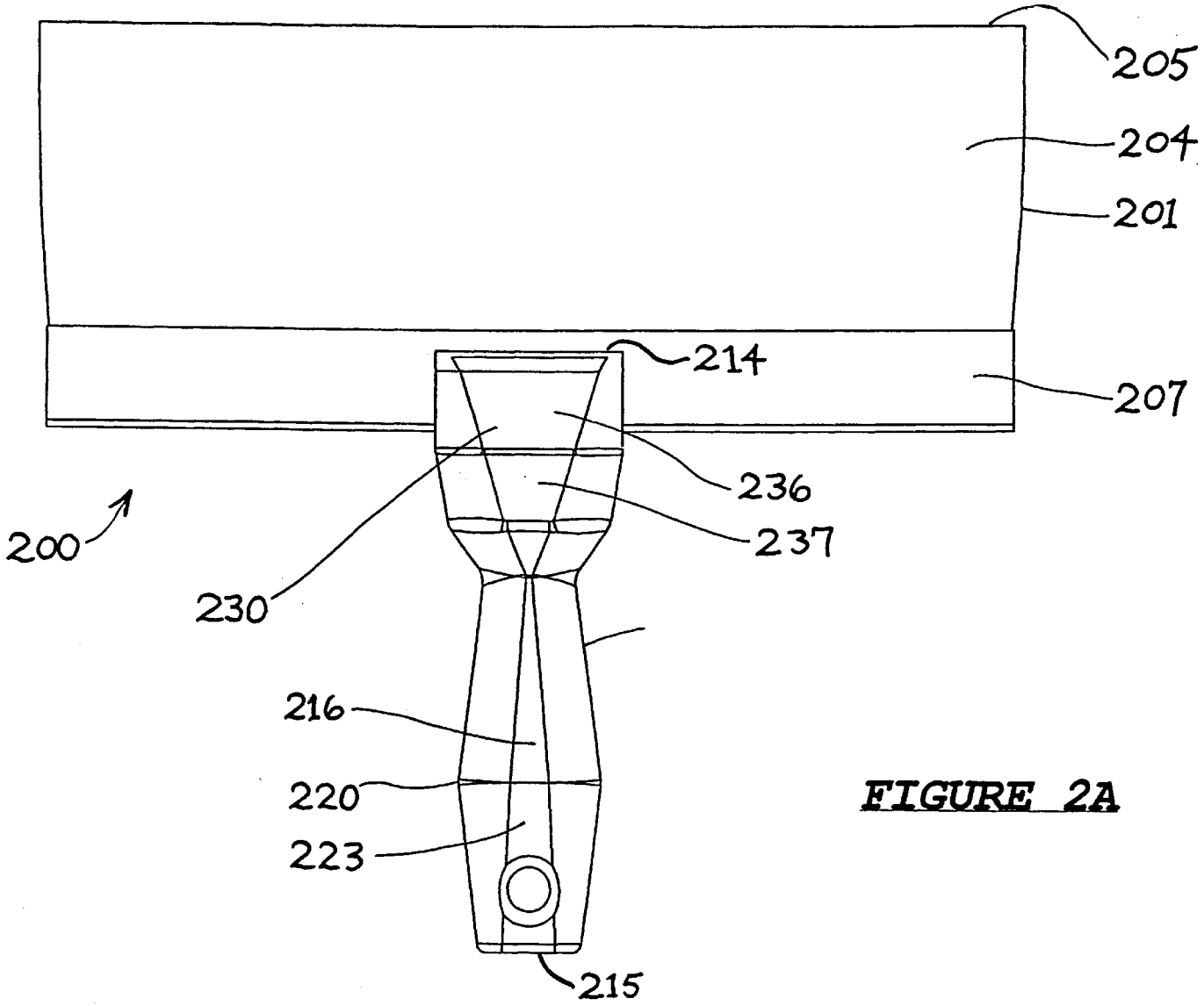
FIG. 2A is a top view of a broad knife in accordance with the present invention.
Figure 2B:
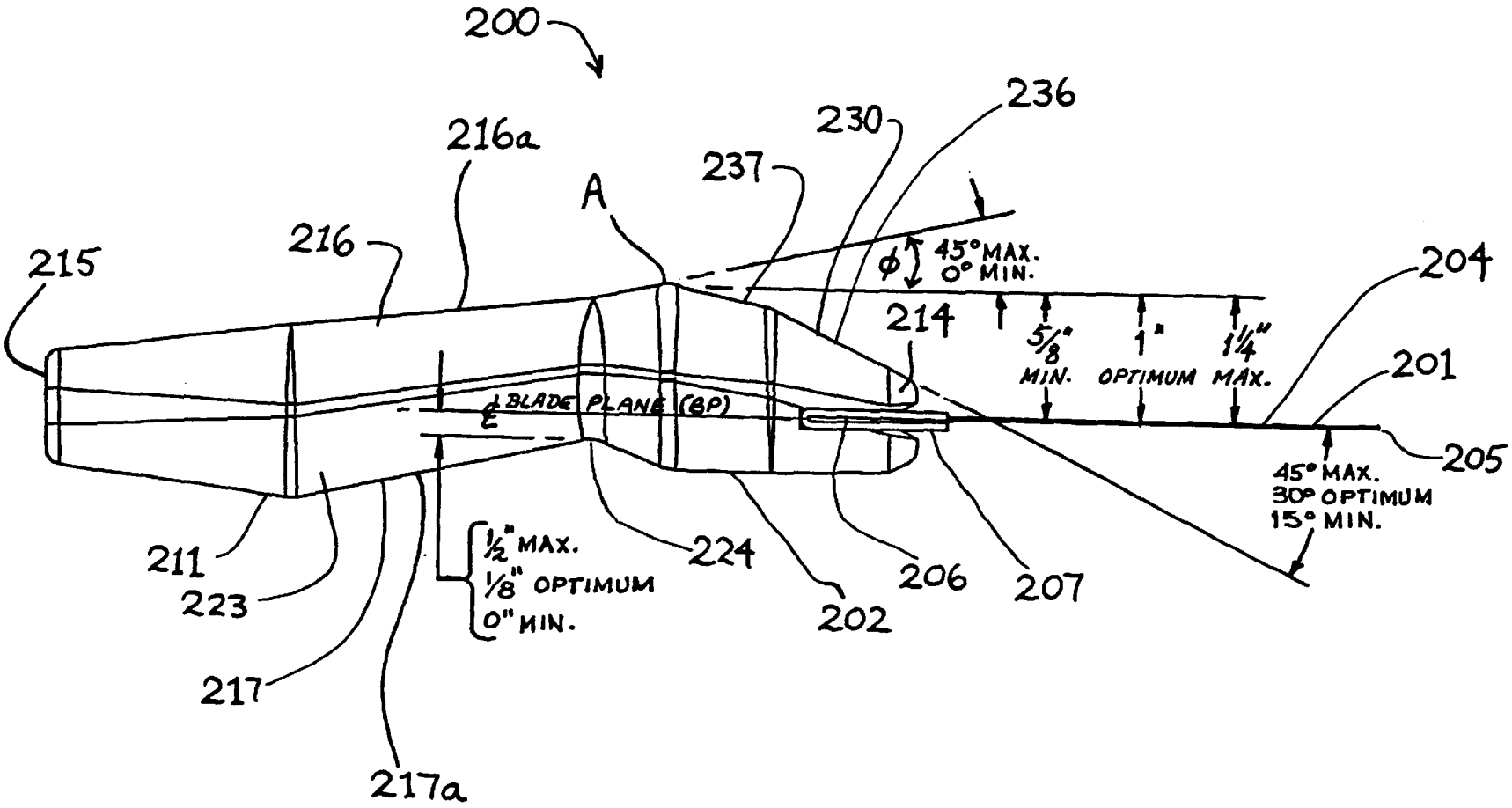
FIG. 2B is a partially dimensioned side view of the broad knife of FIG. 2A.
Figure 2C:
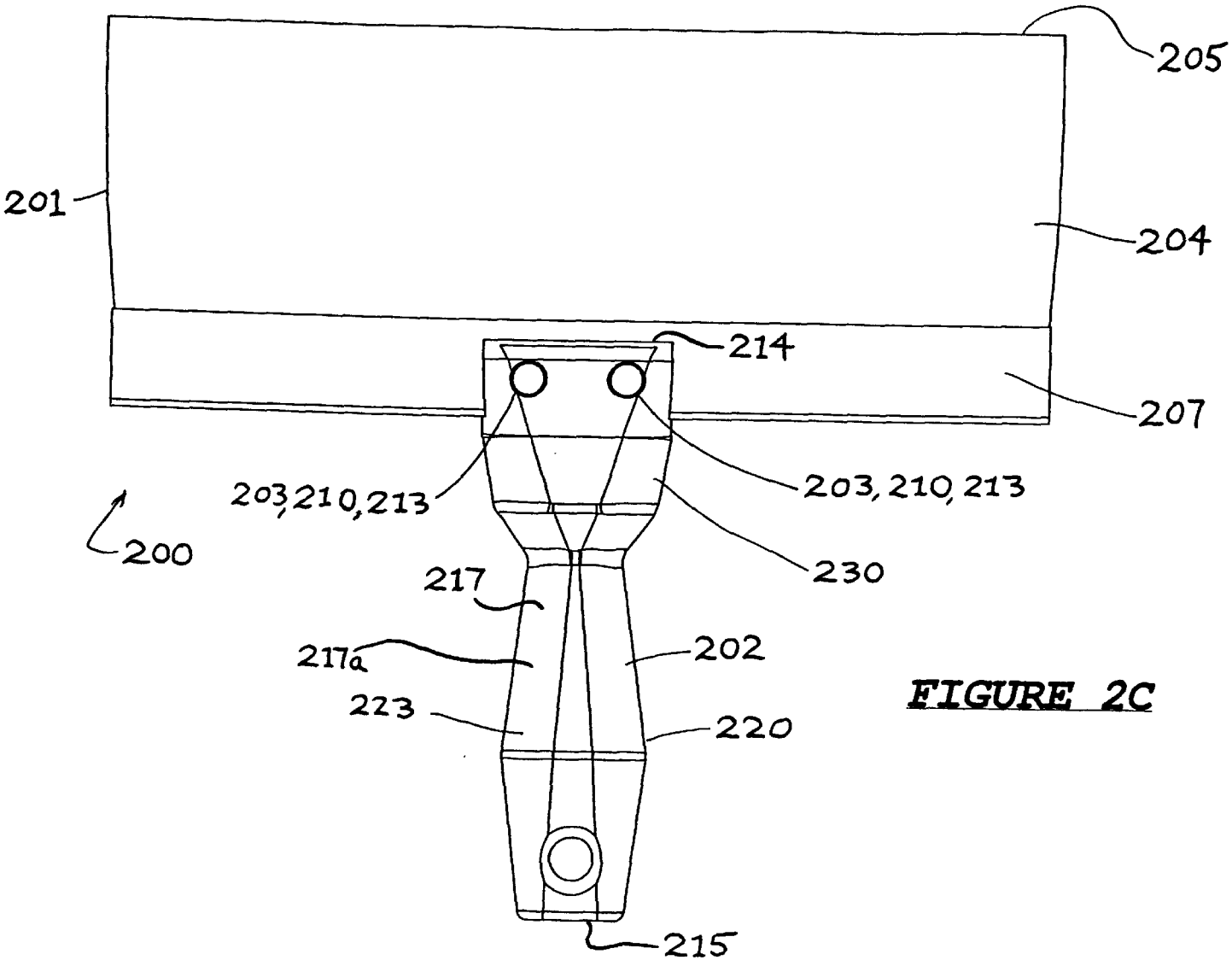
FIG. 2C is a bottom view of the broad knife of FIG. 2A.
Figure 2D:
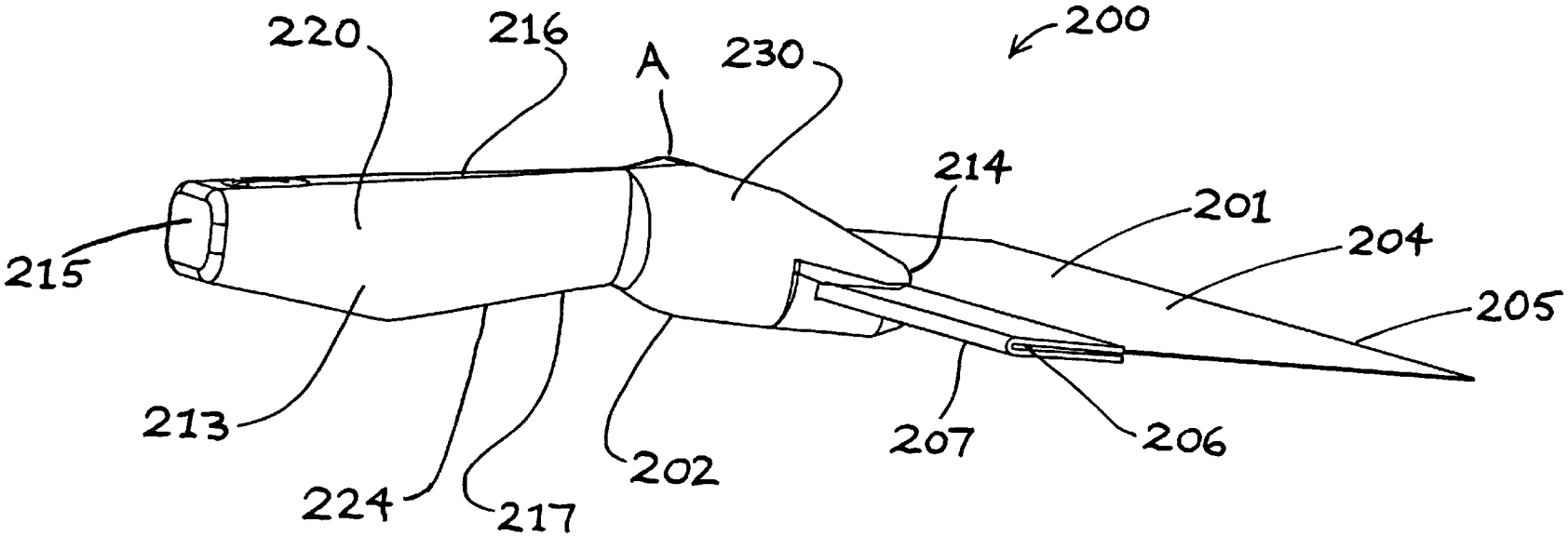
FIG. 2D is a perspective side view of the broad knife of FIG. 2A.
Figure 2E:
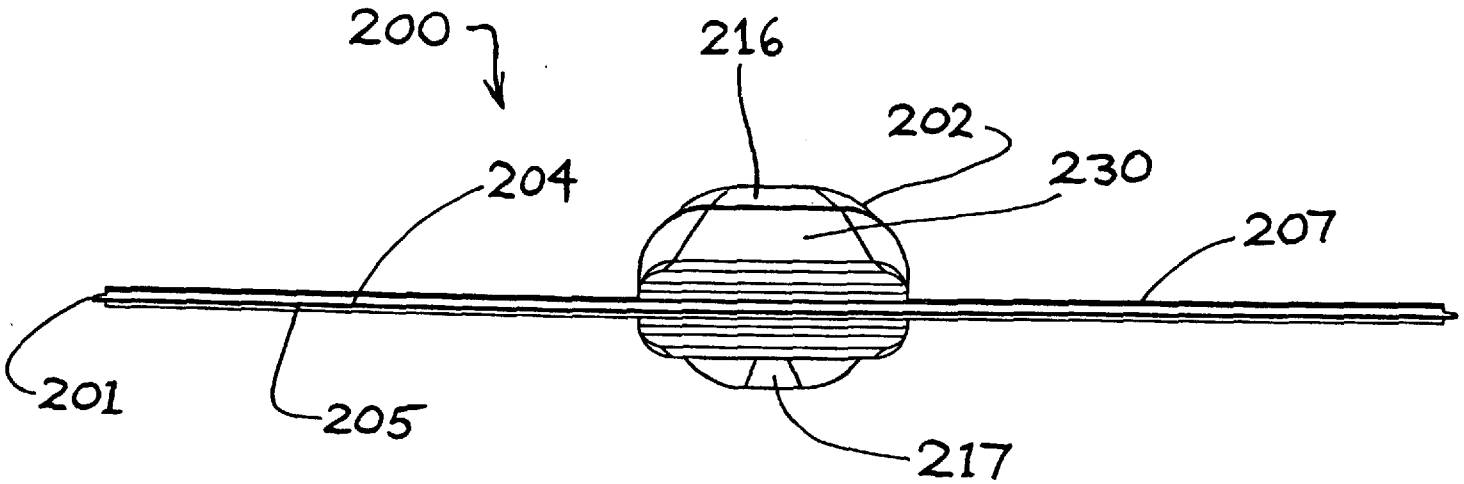
FIG. 2E is an edge-end view of the broad knife of FIG. 2A.
Figure 2F:
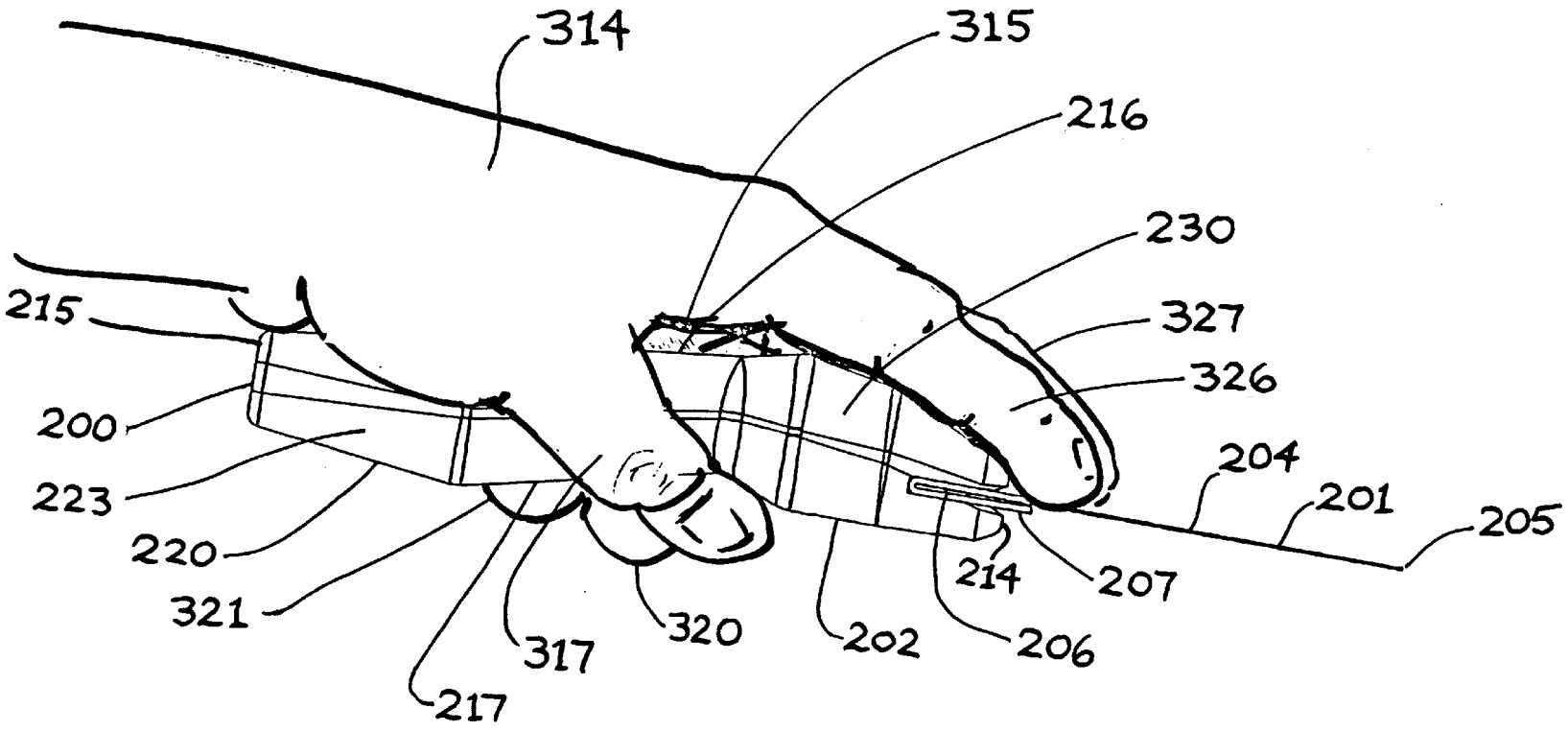
FIG. 2F is a side view of the broad knife of FIG. 2A being held by a left hand, with fore and middle fingers extended over the head of the handle and pressing on the blade.
Figure 2G:
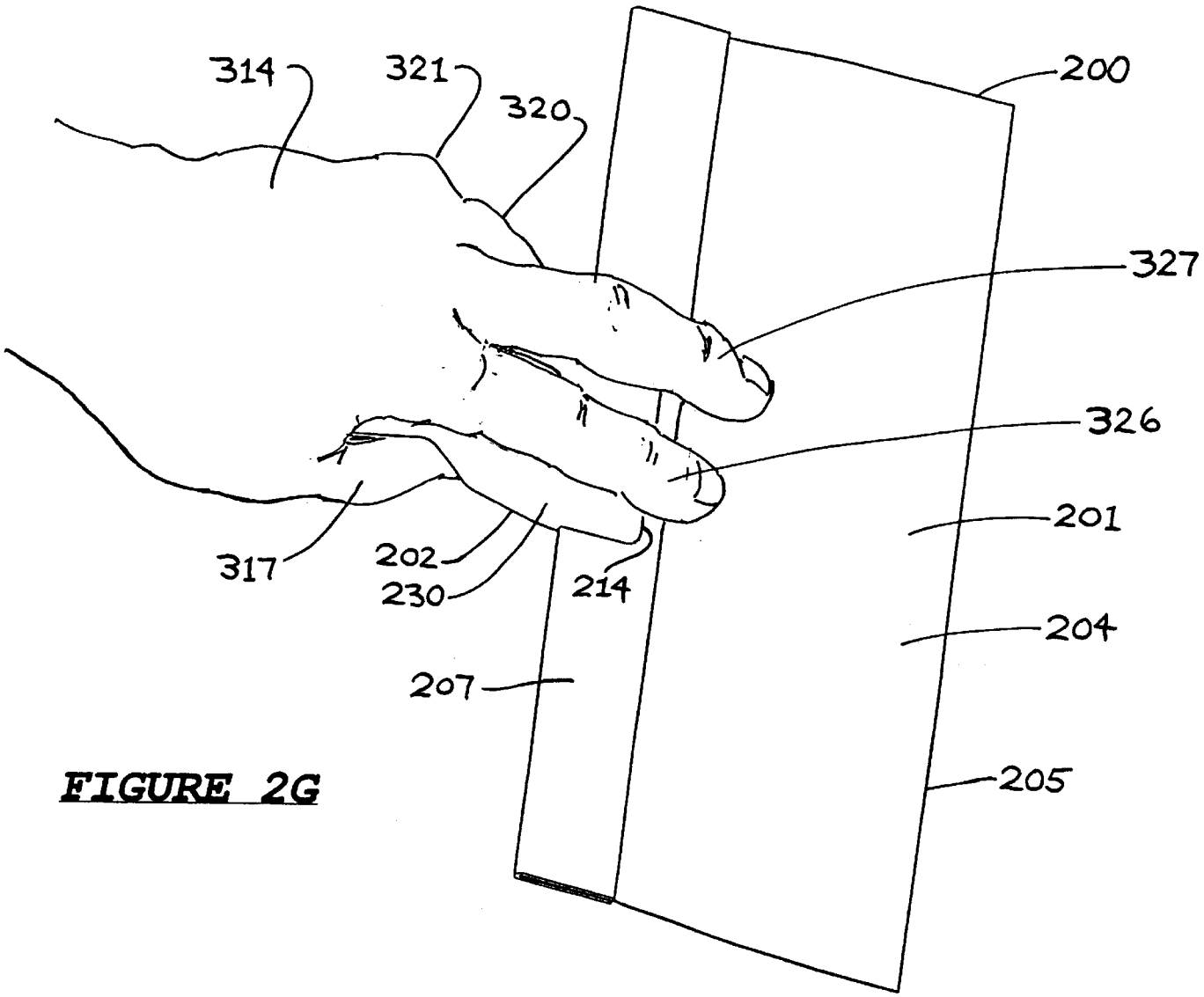
FIG. 2G is a top view of the broad knife of FIG. 2A being held by a left hand.

The gripping portion 220 is shaped to allow either a left hand 314 to grasp the handle 202 as depicted in FIGS. 2F and 2G, or to allow a right hand to so grasp the handle 202. The handle 202 is grasped by lying the palm 315 over its top surface 216 and wrapping the thumb 317, ring finger 320, and little finger 321 around its bulbous body 223. The thumb, ring and little fingers 317, 320 and 321 wrap into a recess 224 on the bottom surface 217 of the handle 202 while the fore finger 326 and middle finger 327 are supported by the arched finger support portion 230 as they extend toward the blade 201. It is suggested but not essential that the recess 224 on the bottom surface 217 be disposed between zero and one half of an inch (0" to ½") from and below the blade plane BP.

The finger support portion 230 of the handle 202 comprises a first sloping planar surface 236 and a second sloping planar surface 237. The first sloping planar surface 236 is disposed adjacent the front end 214 of the handle 202 and is optimally inclined at an angle θ of approximately thirty degrees (30°) upwardly and away from the blade plane BP, in the preferred embodiment, with a suggested range of between fifteen degrees (15°) at the minimum and forty five degrees (45°) at the maximum as shown in FIG. 2B. The second sloping planar surface 237 is disposed rearwardly of the first sloping planar surface 236 and meets the upper surface 216*a* of the handle's gripping portion 220 at an apex A, which apex A preferably lies approximately one inch (1") above the blade plane BP, and slopes downwardly and forwardly therefrom toward the first sloping planar surface 236 and the blade plane BP. While a distance of approximately one inch (1") between the apex A and the blade plane BP is regarded as optimal, it is not essential that the apex A be so disposed; however, it is suggested that this distance be between five-eighths of one inch (⅝") at the minimum and one and one quarter inches (1 ¼") at the maximum. The upper surface 216*a* of the gripping portion 220 is preferably inclined upwardly with respect to the blade plane BP as it extends forward to meet the second sloping planar surface 237 at the apex A, but angular tolerances that are still capable of facilitating the objects of the invention would permit the upper surface 216*a* to be disposed at an angle ϕ of between zero degrees (0°) and forty five degrees (45°) with respect to the blade plane BP. An optimum value for angle ϕ is approximately ten degrees (10°). It is possible, although not preferable, for the first and second sloping planar surfaces 236 and 237 to be co-planar such that they form a single planar sloping surface extending between the apex A and the front end 214 of the handle 202. Although various surface configurations of substantially similar contour provide improvement over prior art handles, the preferred configuration is found to be optimal for the average adult male user. The finger support portion 230 is, furthermore, arched not only to support the extended fingers in that position, but also to suggest to inexperienced users that such a gripping posture be adopted.

Although the present invention has been described in considerable detail with reference to certain preferred embodiments thereof, other embodiments are possible and the foregoing is considered to be illustrative only of the principles of the invention. Furthermore, since numerous modifications and changes will readily occur to those skilled in the art, the spirit and scope of the appended claims should not be limited to the description of the preferred embodiments contained herein.

I claim:

1. A spreading tool for wiping against a work surface comprising:

a blade having a working edge adapted for contacting the work surface and a rear blade edge opposite said working edge, said blade lying in a blade plane; and an elongated handle including a front end, a rear end, a top surface and a bottom surface, said handle being affixed to said blade such that the blade plane passes between said top and bottom surfaces of said handle, said handle further including a gripping portion adjacent said rear end of said handle, said gripping portion having upper and lower surfaces and extending generally rearward of said rear blade edge and being adapted for gripping by a user's hand when the user's fore and middle fingers are substantially extended, and an arched finger support portion adjacent said front end of said handle for supporting the user's substantially extended fore and middle fingers, said arched finger support portion comprising a first sloping planar surface and a second sloping planar surface, said first sloping planar surface being adjacent said front end of said handle and said second sloping planar surface being disposed rearwardly of said first sloping planar surface and meeting said upper surface of said gripping portion at an apex.

2. The spreading tool of claim 1 wherein said upper surface of said gripping portion is disposed at an angle of between zero and forty five degrees (0° and 45°) with respect to the blade plane as said upper surface extends forward from said rear end of said handle toward said apex, said first sloping planar surface of said arched finger support portion is inclined upwardly and away from the blade plane toward said second sloping planar surface of said arched finger support portion at an angle of between fifteen and forty five degrees (15° and 45°) with respect to the blade plane, and said apex lies above the blade plane by a distance of between five-eighths of one inch and one and one-quarter inches (⅝" to 1 ¼").

3. The spreading tool of claim 1 wherein said bottom surface of said handle includes a recess into which a user's thumb, ring and little fingers may reside as the user grips said handle.

4. A broad knife comprising:

a substantially planar thin-walled blade having a straight working edge for contacting a work surface and a rear blade edge opposite said working edge, said blade lying in a blade plane; and an elongated handle having a front end, a rear end, a top surface and a bottom surface, said handle being affixed to said blade such that the blade plane passes between said top and bottom surfaces of said handle, said handle further including a gripping portion adjacent said rear end of said handle, said gripping portion having upper and lower surfaces and extending generally rearward of said rear blade edge and being adapted for gripping by a user's palm, thumb, ring and little fingers wrapped therearound, said upper surface of said gripping portion being disposed at an angle of between zero and forty five degrees (0° and 45°) with respect to the blade plane as said upper surface extends forward from said rear end of said handle, and an arched finger support portion adjacent said front end of said handle for supporting a user's substantially extended fore and middle fingers, said arched finger support portion having a first sloping planar surface and a second sloping planar surface, said first sloping planar surface being adjacent said front end of said handle and said second sloping planar surface being disposed rearwardly of said first sloping planar surface and meeting said upper surface of said gripping portion at an apex.

5. The broad knife of claim 4 wherein said elongated handle extends perpendicularly to said working edge.

6. The broad knife of claim 4 wherein said first sloping planar surface of said arched finger support portion is inclined upwardly and away from the blade plane toward said second sloping planar surface of said arched finger support portion at an angle of between fifteen and forty five degrees (15° and 45°) with respect to the blade plane.

7. The broad knife of claim 4 wherein said bottom surface of said handle includes a recess into which a user's thumb, ring and little fingers may reside as the user grips said handle.

8. The broad knife of claim 7 wherein said recess is between zero inches and one half of one inch (0" to ½") from and below the blade plane.

9. The broad knife of claim 7 wherein said upper surface of said gripping portion is disposed at an angle of approximately ten degrees (10°) with respect to the blade plane as said upper surface extends forward from said rear end of said handle toward said apex and said apex lies above the blade plane by a distance of between five-eighths of one inch and one and one-quarter inches (⅝" to 1 ¼").

10. The broad knife of claim 4 wherein said upper surface of said gripping portion of said handle is inclined at an angle of approximately ten degrees (10°) with respect to the blade plane as said upper surface extends forward from said rear end of said handle toward said apex.

11. The broad knife of claim 10 wherein said apex lies above the blade plane by a distance of approximately one inch (1").

12. The broad knife of claim 11 wherein said first sloping planar surface of said arched finger support portion is inclined upwardly and away from the blade plane toward said second sloping planar surface of said arched finger support portion at an angle of approximately thirty degrees (30°) with respect to the blade plane.

13. The broad knife of claim 12 wherein said bottom surface of said handle includes a recess into which a user's thumb, ring, and little fingers may reside as the user grips said handle and wherein said recess is between zero inches and one half of one inch (0" to ½") from and below the blade plane.

14. The broad knife of claim 4 wherein said first and second sloping planar surfaces of said arched finger support portion are co-planar.

15. The broad knife of claim 14 wherein said co-planar first and second sloping planar surfaces of said arched finger support portion are inclined upwardly and away from the blade plane toward said apex at an angle of between fifteen and forty five degees (15° and 45°) with respect to the blade plane.

16. A broad knife comprising:

a substantially planar thin-walled blade having a straight working edge for contacting a work surface and a rear blade edge opposite said working edge, said blade lying in a blade plane; and an elongated handle having a front end a rear end, a top surface and a bottom surface, said handle being affixed to said blade such that the blade plane passes between said top and bottom surfaces of said handle, said handle further including a gripping portion adjacent said rear end of said handle, said gripping portion having upper and lower surfaces and extending generally rearward of said rear blade edge and being adapted for gripping by a user's palm, thumb, ring and little fingers wrapped therearound, said upper surface of said gripping portion being disposed at an angle of approximately degrees (10°) with respect to the blade plane as said upper surface extends forward from said rear end of said handle, said bottom surface of said handle having a recess adapted to receive the user's thumb, ring and little fingers, said recess being disposed between zero inches and one half of one inch (0" to ½") from and below the blade plane; and an arched finger support portion adjacent said front end of said handle for supporting the user's substantially extended fore and middle fingers, said arched finger support portion having a first sloping planar surface and a second sloping planar surface, said first sloping planar surface being adjacent said front end of said handle and said second sloping planar surface being disposed rearwardly of said first sloping planar surface and meeting said upper surface of said gripping portion at an apex, said first sloping planar surface of said arched finger support portion being inclined upwardly and away from the blade plane toward said second sloping planar surface of said arched finger support portion at an angle of between fifteen and forty five degrees (15° and 45°) with respect to the blade plane, and said apex lies above the blade plane by a distance of between five-eighths of one inch and one and one-quarter inches (⅝" to 1 ¼").

17. The broad knife of claim 16, wherein said apex is disposed approximately one inch (1") from and above the blade plane.

18. The broad knife of claim 17 wherein said first sloping planar surface of said arched finger support portion is inclined upwardly and away from the blade plane toward said second sloping planar surface of said arched finger support portion at an angle of approximately thirty degrees (30°) with respect to the blade plane.

19. The broad knife of claim 16 wherein said first sloping planar surface of said arched finger support portion is inclined upwardly and away from the blade plane toward said second sloping planar surface of said arched finger support portion at an angle of approximately thirty degrees (30°) with respect to the blade plane.

* * * * *